United States Patent [19]

Martinez

[11] Patent Number: 4,665,615

[45] Date of Patent: May 19, 1987

[54] RAZOR WITH DISPOSABLE BLADE

[76] Inventor: Irene Martinez, 6759 SW. 14 St., Miami, Fla. 33144

[21] Appl. No.: 835,343

[22] Filed: Mar. 3, 1986

Related U.S. Application Data

[63] Continuation-in-part of Ser. No. 730,366, Jul. 11, 1985, abandoned.

[51] Int. Cl.[4] ..... B26B 21/10

[52] U.S. Cl. ..... 30/53

[58] Field of Search ..... 30/53, 54, 55

[56] References Cited

U.S. PATENT DOCUMENTS

| | | | |
|---|---|---|---|
| 917,043 | 4/1909 | Gage | 30/55 X |
| 2,192,362 | 3/1940 | Merlo | 30/53 |
| 2,479,788 | 8/1949 | Stokes | 30/53 |
| 3,106,020 | 10/1963 | Tape | 30/55 X |
| 3,255,523 | 6/1966 | Robertson et al. | 30/53 |
| 3,308,533 | 3/1967 | Holohan | 30/53 |
| 3,383,763 | 5/1968 | Strandfors | 30/53 |

FOREIGN PATENT DOCUMENTS

| | | | |
|---|---|---|---|
| 188299 | 6/1906 | Fed. Rep. of Germany | 30/53 |

*Primary Examiner*—Jimmy C. Peters
*Attorney, Agent, or Firm*—Jesus Sanchelima

[57] ABSTRACT

A disposable blade carriage for straight razors that have a holder member and a guard member pivotally mounted on each other. The blade carriage is removably mounted in a longitudinally extending slot in the holder member. The blade carriage includes a latching mechanism on one end that rigidly attaches the carriage to the holder member and a hook member that prevents it from falling off from the other end.

1 Claim, 10 Drawing Figures

RAZOR WITH DISPOSABLE BLADE

OTHER RELATED APPLICATIONS

The present application is a continuation-in-part of pending U.S. patent application Ser. No. 730,366 filed on July 11, 1985, now abandoned, which is hereby incorporated by reference.

BACKGROUND OF THE INVENTION

1. Field of the Invention.

The present invention relates to razors, and more particularly, to razors with blades mounted on disposable carriages.

2. Description of the Related Art.

The closest related art known to applicant corresponds to the following U.S. patents: Merlo (U.S. Pat. No. 2,192,362); Stokes (U.S. Pat. No. 2,479,788); Robertson (U.S. Pat. No. 3,255,523); Stradfors (U.S. Pat. No. 3,383,763); Holohan (U.S. Pat. No. 3,308,533); and German Pat. No. 188,299 issued to Crookes.

Even though these patents disclose different designs for removable blades, none of them provide a carriage for the blades. Therefore, the user has to handle the blades directly, mount them on the razor and adjust the tightness and exposure of the blade. This lends itself to lack of uniformity in going from blade to blade and time wasted. In the present invention, these problems are resolved by providing a carriage where the blade itself is mounted. The carriage locks inside the blade holder portion of a conventional straight barber razor. The blade is rigidly mounted on the carriage providing a predetermined exposure for its edge every time is mounted to the holder portion.

In Merlo, for instance, a razor blade 19 engages inside holder 10 frictionally on surfaces 16*a* and 18*a*. This direct engagement is susceptible to fatigue of the holder's side walls 14, dirt being accumulated, etc. The user is provided with notch 22 on both sides of razor blade to directly move the blade. It is obvious that in Merlo's design, the spring action of the engaging walls may weaken with use.

In Stokes, the design involving a lever 15 with a lug 17 that engages with a notched end on a blade is supposed to provide the desired solid support. However, it can be seen that even by the user's manipulation of the razor is possible to unlock this mechanism inadvertently.

Robertson's razor blade holder has bifurcated FIGS. 14 and 16 with recess 25 that holds blade 24 when beveled surface 35 engages surface 32, and also beveled surface 36 that fits in pressure contact with surface 34. Again, blade 24 is directly mounted to holder 12 by sandwiching it between fingers 14 and 16 by virtue of its flexibility or resilience. This design is also susceptible to fatigue of these flexible elements.

Still another mechanism for attaching a removable blade is disclosed in Stradfor's patent. Here, a ring 38 encircles and slides over shank 28 and blade 12 thereby secured to support member 20. The risk of injuring the user is, possible since he has to continuously slide the blade to remove it. See column 4, line 12.

Holohan's patent involves a clip mechanism that is spring loaded, and like in the previous disclosure, the user is required to use his fingers directly to insert the blade and remove it.

The German patent is similar to Stradfor's reference, wherein a ring is used to lock blade a in place. However, the user may inadvertently slide ring d and loosen blade a. Again, the user has to handle blade a directly.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a straight razor that utilizes blades mounted on disposable carriages that can be readily mounted and demounted from the razor blade holder member.

It is another object of this invention to provide disposable blade carriages that can be reliably mounted to the razor blade holder member and being of several predetermined and uniform exposure of the blade's edge that will depend on the application intended by the user.

Yet another object is to provide such a razor that utilizes disposable carriages and blades that are inexpensive and simple to manufacture.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 10:
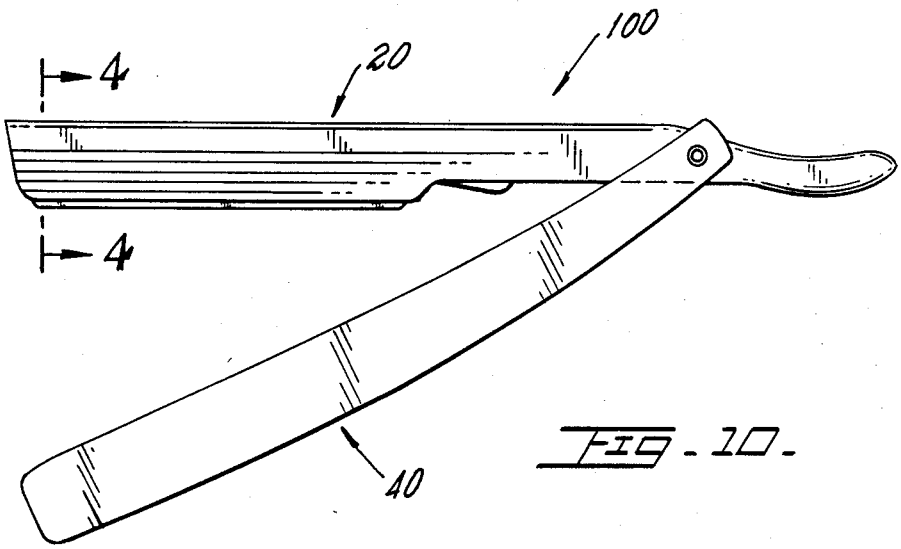
FIG. 10 shows an elevation of the razor with the blade carriage loaded thereon.

Referring now to FIG. 10, it can be seen that the razor subject of the present application is referred to generally with numeral 100. It comprises, basically, of holder member 20 and guard member 40.

Figure 1:
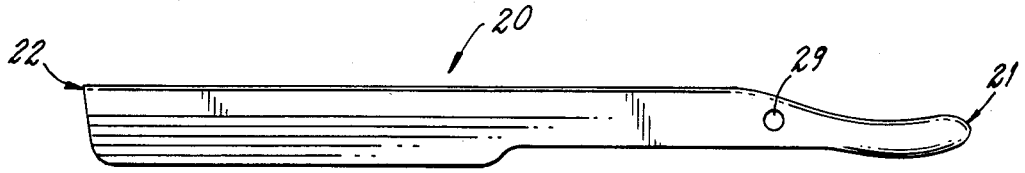
FIG. 1 is an elevation view of the blade holder portion of the improved straight razor.
Figure 2:
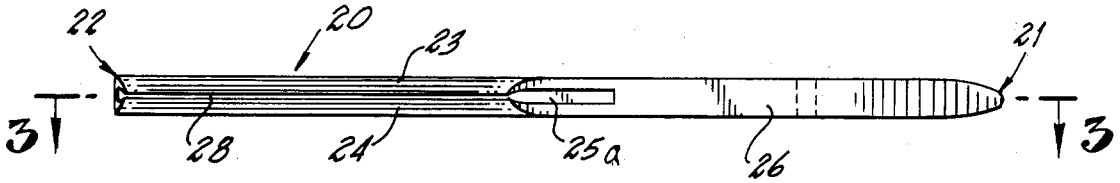
FIG. 2 shows a bottom view of the blade holder shown in FIG. 1.
Figure 3:
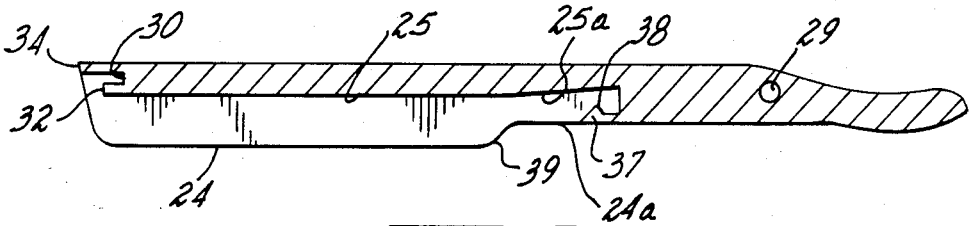
FIG. 3 illustrates a cross-sectional view taken along line 3—3 in FIG. 2.
Figure 4:
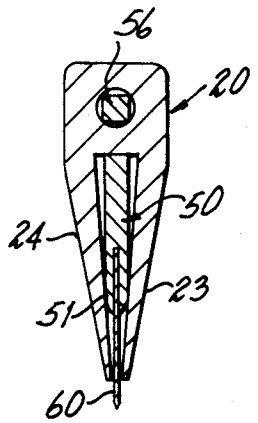
FIG. 4 is a cross-sectional view taken along line 4—4 in FIG. 10.
Figure 5:
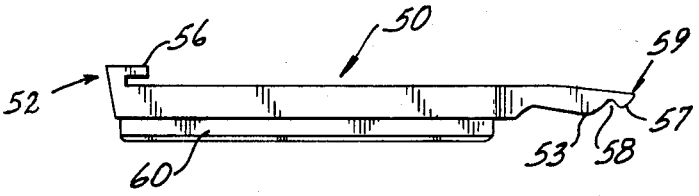
FIG. 5 shows an elevation of the blade carriage with a blade mounted, thereto.
Figure 6:
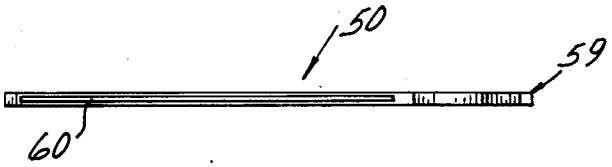
FIG. 6 is a bottom view of the carriage shown in FIG. 5.

Holder member 20 is shown in FIGS. 1; 2 and 3 without blade carriage member 50 which is shown in FIGS. 4; 5 and 6. Holder member 20 is an elongated shank 26 that includes a slot 28 that extends substantially from the middle to outer end 22. Slot 28 is defined by identical and opposite lateral walls 23 and 24 and slot top surfaces 25 and 25*a*. Walls 23 and 24 extend downwardly from the underside of shank 26. A cavity 30 is formed above slot top surface 25 and sandwiched between termination surfaces 32 and 34, as shown in FIG. 3. A through opening 29 is located substantially towards inner end 21. Side walls 23 and 24 have an elevational shape that include shoulder 39. A protrusion 37 extends outwardly (to the left) from the beginning of slot 28 and includes a headed portion 38.

Blade carriage member 50 carries blade member 60 which is rigidly attached to the underside of member 50. Member 50 is made out of a resilient material, such as plastic, and has a substantially elongated shape, having outer and inner extremes 52 and 59, terminating on a J-shape hook 56 on its outer end. Hook 56 is designed and adapted to engage with cavity 30 through pressure contact preventing any further movement inwardly (to the right) of carriage member 50 after a predetermined distance has penetrated inside shank 26 or downwardly away from shank 26. Hook 56 provides further structural integrity to the solid support provided by side walls 23 and 24 that sandwich carriage member 50. The outwardly movement is prevented, once member 50 is slidably mounted inside holder member 20, by the latch engagement of notch 58 with headed termination 38 of protrusion 37. As member 50 slides in, headed termination 38 provides a cam action that deflects inner extreme 59 upwardly slightly until tip 57 clears headed termination 38. It can be observed that slot top surface 25 is raised slightly at 25*a* thereby allowing the deflection to take place. Lump 53 extends downwardly enough to protrude beyond the edge of side wall 24 at 24*a*, so that the user may release the engagement of headed termination 38 with notch 58 by deflecting inner end 59 toward slot top surface 25*a*.

In FIG. 4 it can be observed that the horizontal upper part of hook 56 has a square cross-section that fits snuggly inside cavity 30. Carriage member 50 is sandwiched between side walls 23 and 24 which frictionally support member 50 at 51 and blade 60 protrudes beyond the termination of side walls 23 and 24 a predetermined distance that is sufficient to provide a suitable cutting edge with only slight deflection. Some deflection is necessary to absorb the pulling of hair that is always present even with the sharpest blades. However, the exposure of blade 60, once its optimum is established from a particular use (mustache, hair, etc.) will be preestablished by the particular carriage that is loaded. The user may then readily change carriages to better accommodate his needs.

Figure 7:
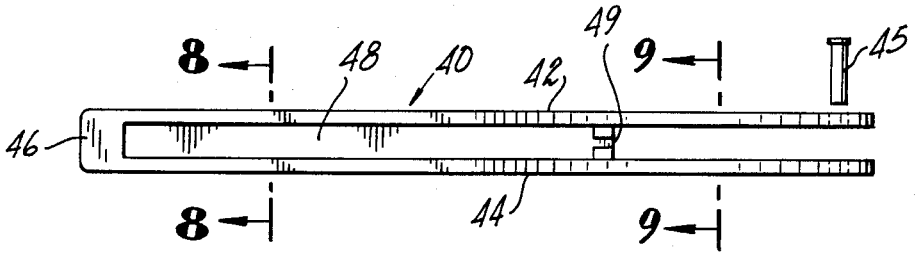
FIG. 7 shows the guard or cover portion of the razor.
Figure 8:
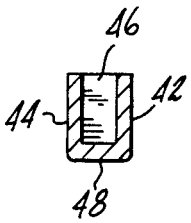
FIG. 8 is a cross-section along line 8—8 in FIG. 7.
Figure 9:
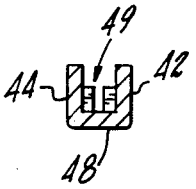
FIG. 9 is a cross-sectional view of the guard shown in FIG. 7, along line 9—9.

In FIG. 7, a top view of the guard portion 40 of razor 100 is shown. It can be observed that from the top it has substantially a U-shape with flat members 42 and 44 that are held in spaced apart parallel relationship by connecting member 46 and cover member 48. Holder stopper 49 stops holder member 20 from going beyond a certain distance toward cover member 48 which covers and protects the exposed edge of blade 60. Pin 45 provides the fulcrum point for guard member 40 and holder member 20. FIGS. 8 and 9 show the relative positions of members 42; 44; 46 and 48 with respect to each other and one way of implementing holder stopper 49.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A straight razor, comprising:

A. a holder member of elongated shape having a shank with inner and an outer ends and two opposite and identical downwardly extending walls defining a slot that runs longitudinally along said shank member wherein said slot begins substantially from the middle of said holder member and extends outwardly to the end of said elongated member and wherein said holder member includes a headed protrusion that extends outwardly and being positioned at the beginning of said slot and said headed protrusion cooperates with said latching means to removably lock said carriage rigidly with respect to said holder member and wherein said holder member includes a longitudinal cavity extending from the outer end of said shank inwardly and said carriage member includes a J-shaped hook that cooperatively engages in said cavity thereby providing a solid support of said carriage member;

B. a carriage member having an elongated shape and means for latching to said holder member and wherein said latching means includes a downwardly extending tip on said inner extreme and an adjacent notch that engage cooperatively with said heated protrusion and said latching means further includes a lump adjacent to said notch and so constructed to protrude downwardly beyond said walls so that a user may push it upwardly to disengage said latching means having inner and outer extremes, with an underside and including a blade member longitudinally and rigidly mounted to the underside of said carriage member which is so adapted and constructed to be removably mounted inside said slot;

C. a guard member pivotally mounted on one end to of said holder member.

* * * * *